US006233783B1

(12) United States Patent
Dubach

(10) Patent No.: US 6,233,783 B1
(45) Date of Patent: May 22, 2001

(54) HINGE

(75) Inventor: Fredi Dubach, Adetswil (CH)

(73) Assignee: Julius Blum Gesellschaft m.b.H., Höchst (AT)

( * ) Notice: Subject to any disclaimer, the term of this patent is extended or adjusted under 35 U.S.C. 154(b) by 0 days.

(21) Appl. No.: 09/370,242

(22) Filed: Aug. 9, 1999

(30) Foreign Application Priority Data

Aug. 11, 1998 (AT) ..... 1379/98

(51) Int. Cl.[7] ..... E05D 7/04

(52) U.S. Cl. ..... 16/237; 16/236; 16/242; 16/246

(58) Field of Search ..... 16/237, 236, 238, 16/242, 245, 246, 257, 258, 382

(56) References Cited

U.S. PATENT DOCUMENTS 4,412,366 * 11/1983 Rock et al. ..... 16/236
4,799,289 * 1/1989 Grass ..... 16/236
5,119,527 * 6/1992 Rock ..... 16/238
5,210,907 * 5/1993 Toyama ..... 16/258
5,799,370 * 9/1998 Davidian et al. ..... 16/236
5,937,479 * 8/1999 Ohshima et al. ..... 16/257
6,032,333 * 3/2000 Brustle ..... 16/242

FOREIGN PATENT DOCUMENTS 2 131 079 6/1984 (GB) .

* cited by examiner

*Primary Examiner*—Chuck Y. Mah
(74) *Attorney, Agent, or Firm*—Wenderoth, Lind & Ponack, L.L.P.

(57) ABSTRACT

A hinge with adjusting devices in which a hinge arm can manually be secured to a base plate by means of an intermediate piece. The hinge arm is connected to a second hinge fastening part, for example a hinge cup, by articulated hinge links. The hinge arm is displaceable with respect to the intermediate piece in the direction of a depth of the piece of furniture and in a direction perpendicular to a side wall of the piece of furniture. Each adjusting device includes a manually operatable member for displacement of the hinge arm.

14 Claims, 8 Drawing Sheets

HINGE

BACKGROUND OF THE INVENTION

The invention relates to a hinge with adjusting devices in which a hinge arm can manually be secured to a base plate by means of an intermediate piece, the hinge arm being connected to another hinge part, for example a hinge cup, by means of articulated hinge links or the like, the hinge arm being displaceable with respect to the intermediate piece in the direction of the depth of the piece of furniture and in a direction perpendicular to a side wall of a piece of furniture.

A hinge of this type is known from WO 86/02402.

When mounting such a hinge it is sufficient to hang the hinge arm, which is provided with a intermediate piece, on to the mounting or base plate and to tilt the hinge arm and the intermediate piece towards the side wall of the piece of furniture, whereby the intermediate part is automatically arrested on the mounting plate. Mounting and dismounting of the hinge arm on and from the mounting plate can be done manually without the use of a tool. However, for adjusting the position of the hinge arm with respect to the mounting plate a screw driver is needed.

German utility patent 69 40 349 shows a hinge with a hinge arm mounted on a mounting plate, whereby a manually adjustable fastening screw is mounted on the mounting plate. To adjust the position of the hinge arm with respect to the mounting plate, it is necessary to loosen the fastening screw by means of which the hinge arm is held on the mounting plate. For loosening the fastening screw a screw driver is necessary. After an adjustment screw has been brought into a desired position, the hinge arm is pressed against the adjustment screw and the fastening screw is tightened again by means of a screw driver.

SUMMARY OF THE INVENTION

It is the object of the present invention to improve a hinge of the afore mentioned kind such that adjustment of the position of the hinge arm with respect to the mounting plate can be achieved manually without the use of a tool and without it being necessary to unlock the hinge arm before the adjustment takes place and to separately fasten the hinge arm after adjustment.

According to the invention this is achieved in that each adjusting device includes a manually operatable member for displacement of the hinge arm.

An exemplary embodiment of the invention provides for the hinge arm to have a U-shaped profile with two lateral webs, the manually operatable member being a wheel which is mounted within the U-profile of the hinge arm and which protrudes through an opening in at least one lateral web of the hinge.

Such a wheel can be turned easily by direct contact with a hand of a user.

A further embodiment of the invention provides an adjusting device including a disk with a groove in the form of a spiral, and a peg being provided on the intermediate piece and protruding into such groove so that by turning of the disk the hinge arm is displaceable with respect to the intermediate piece in the direction of the depth of the piece of furniture.

BRIEF DESCRIPTION OF THE DRAWINGS

The present invention will now be described in more detail by way of example only with reference to the accompanying drawings wherein.

DETAILED DESCRIPTION OF THE INVENTION

Figure 1:
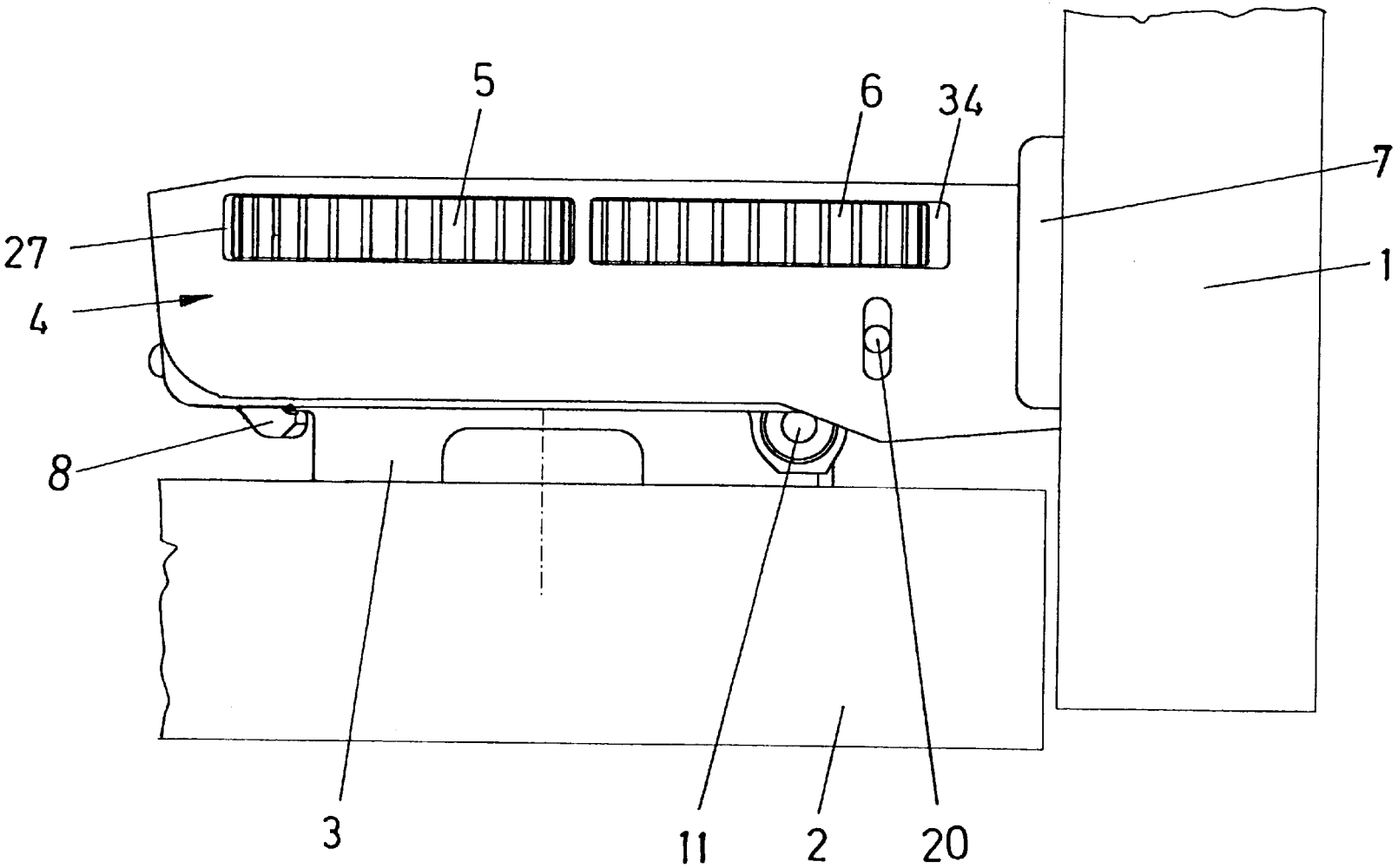
FIG. 1 is a side view of a hinge according to the invention.
Figure 2:
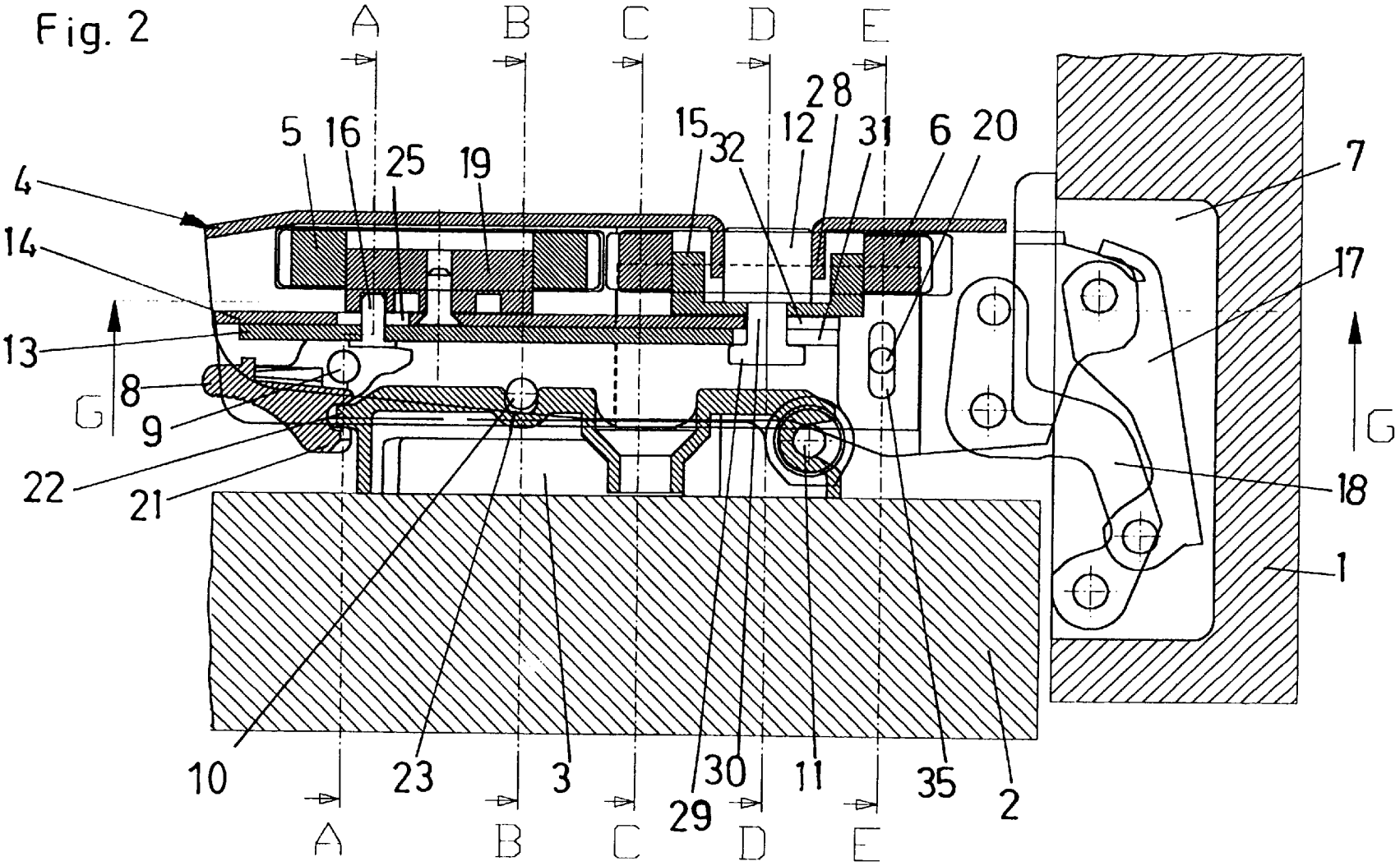
FIG. 2 is a longitudinal section through a hinge arm and a base plate in a plane perpendicular to the furniture side wall.
Figure 3:
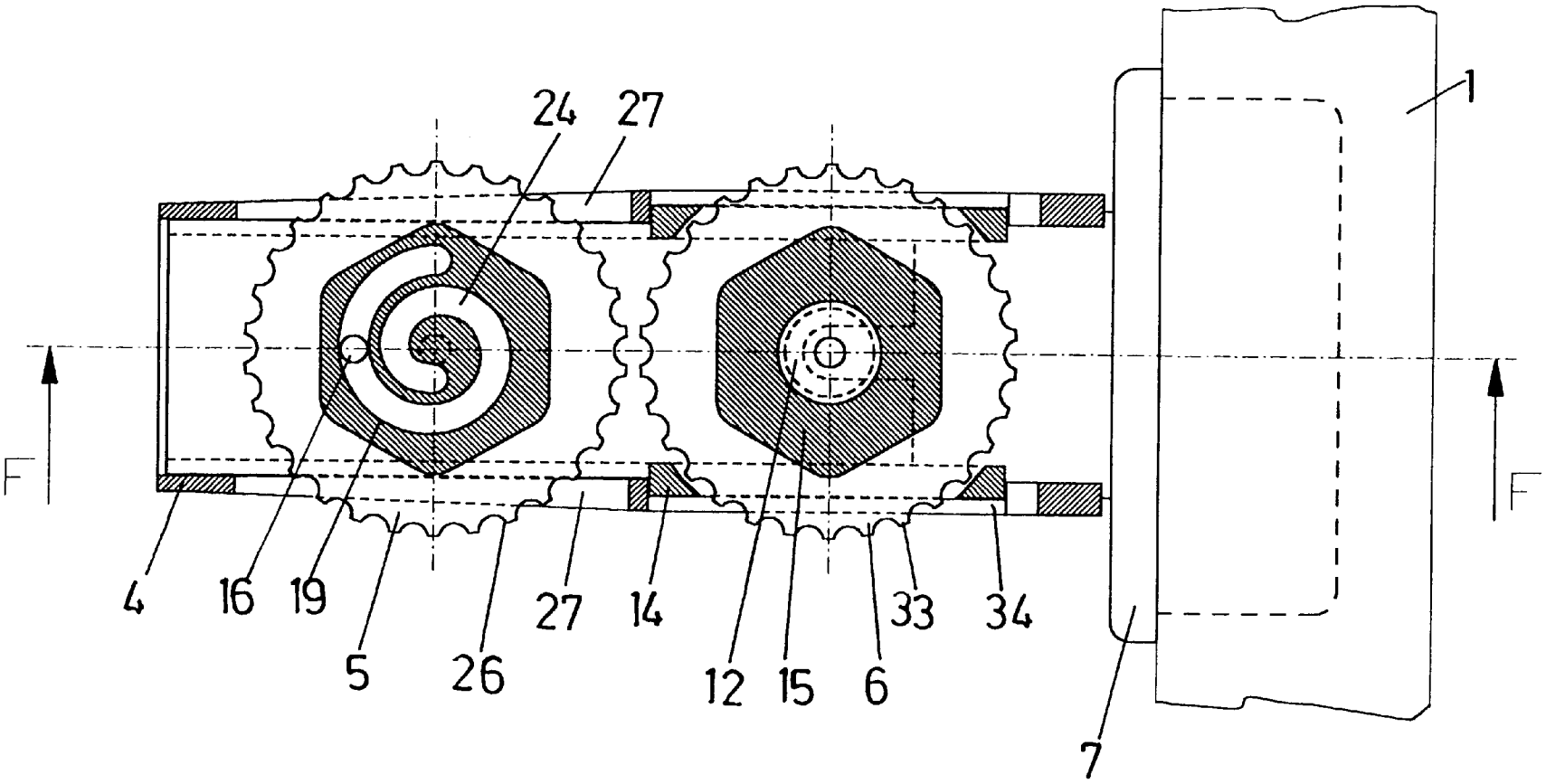
FIG. 3 is a sectional view along line G—G of FIG. 2.
Figure 4:
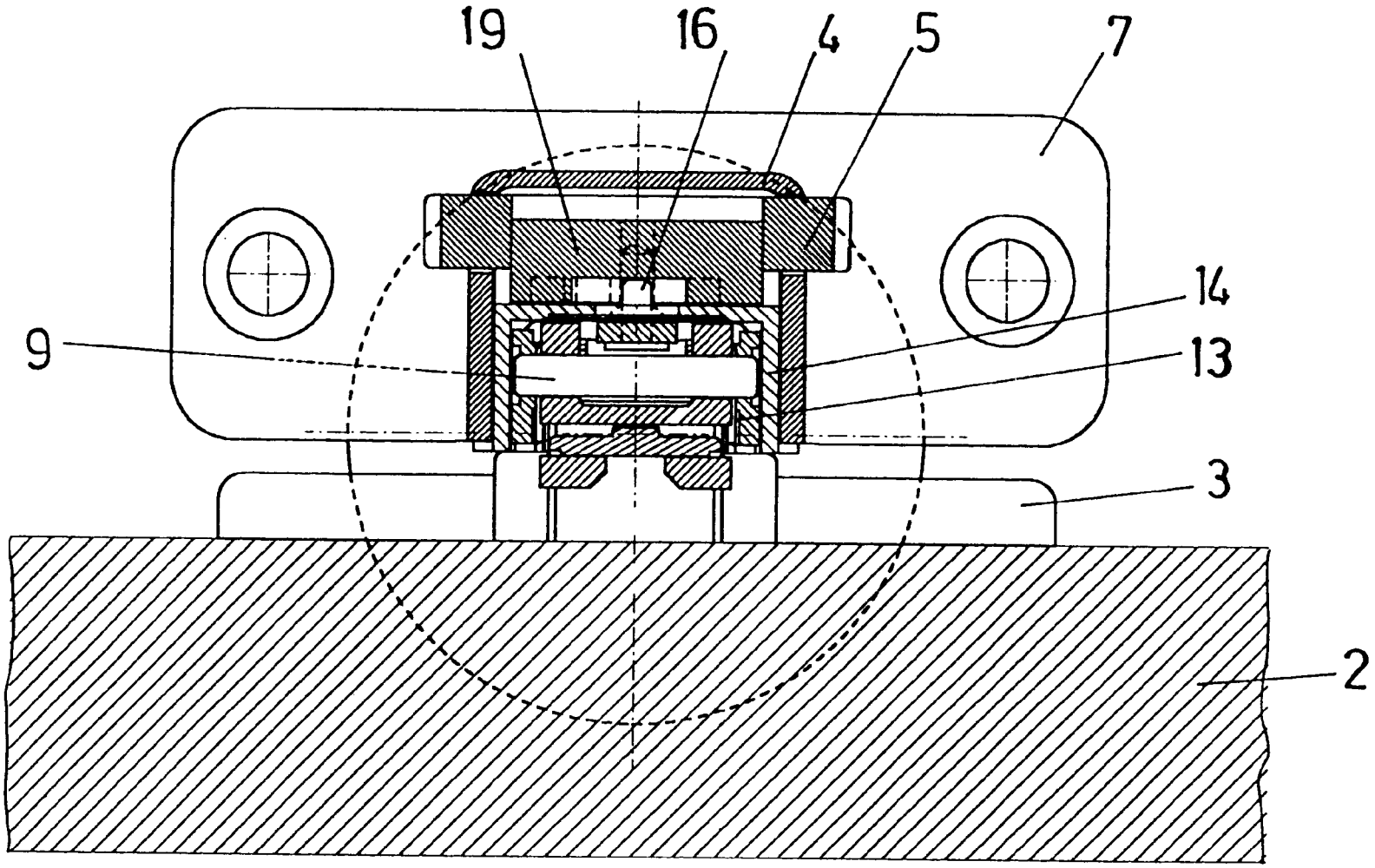
FIG. 4 is a sectional view along line A—A of FIG. 2.
Figure 5:
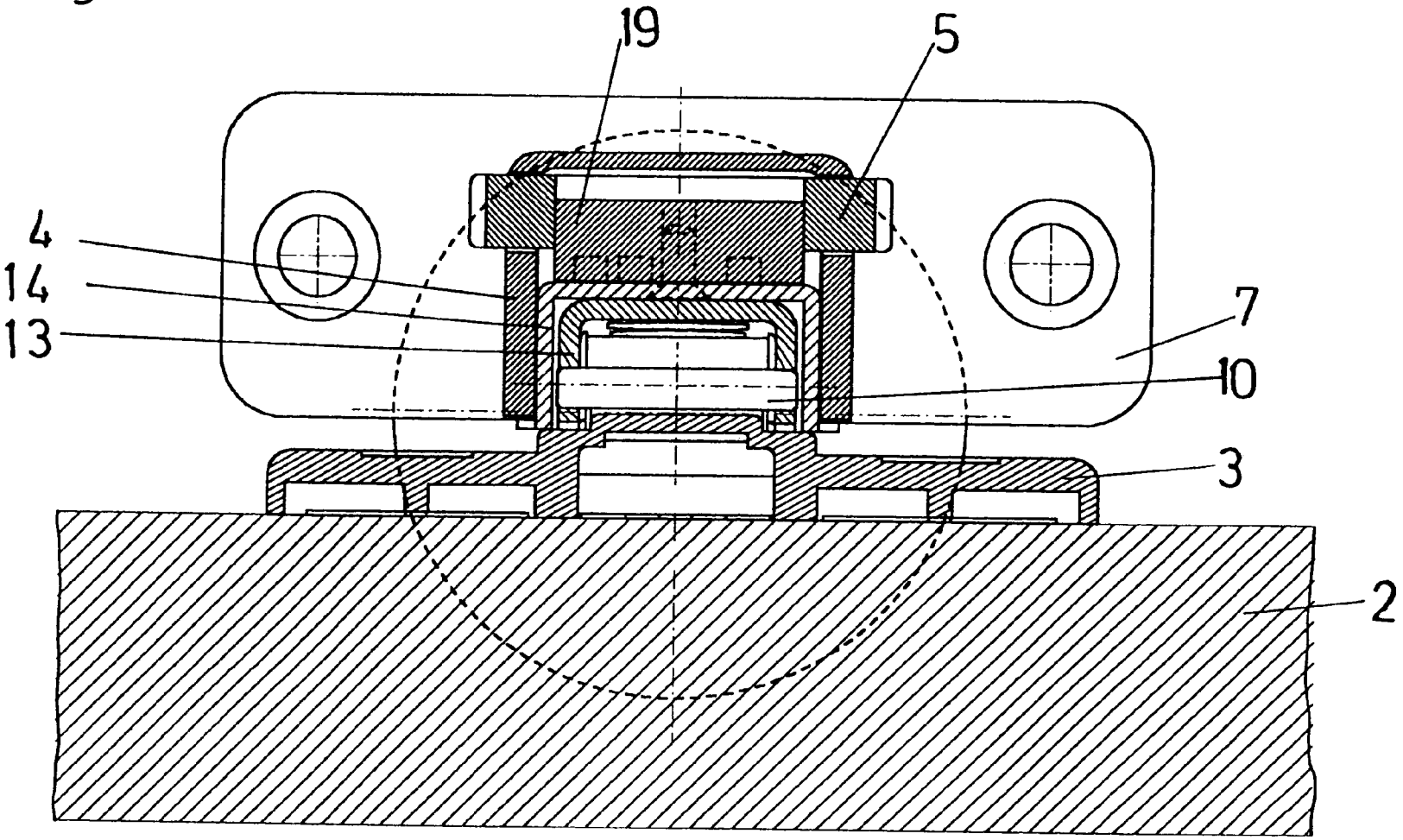
FIG. 5 is a sectional view along line B—B of FIG. 2.
Figure 6:
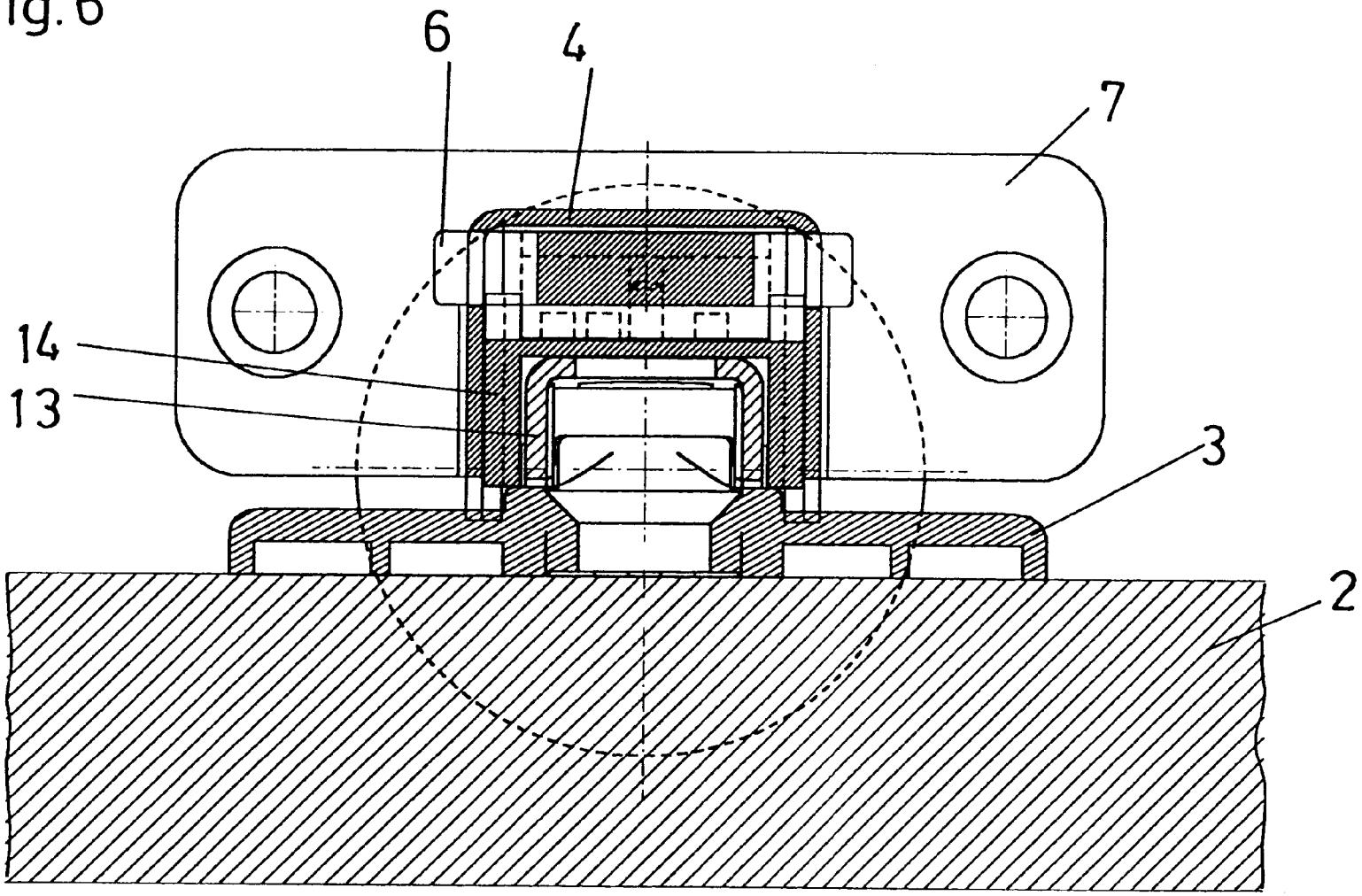
FIG. 6 is a sectional view along line C—C of FIG. 2.
Figure 7:
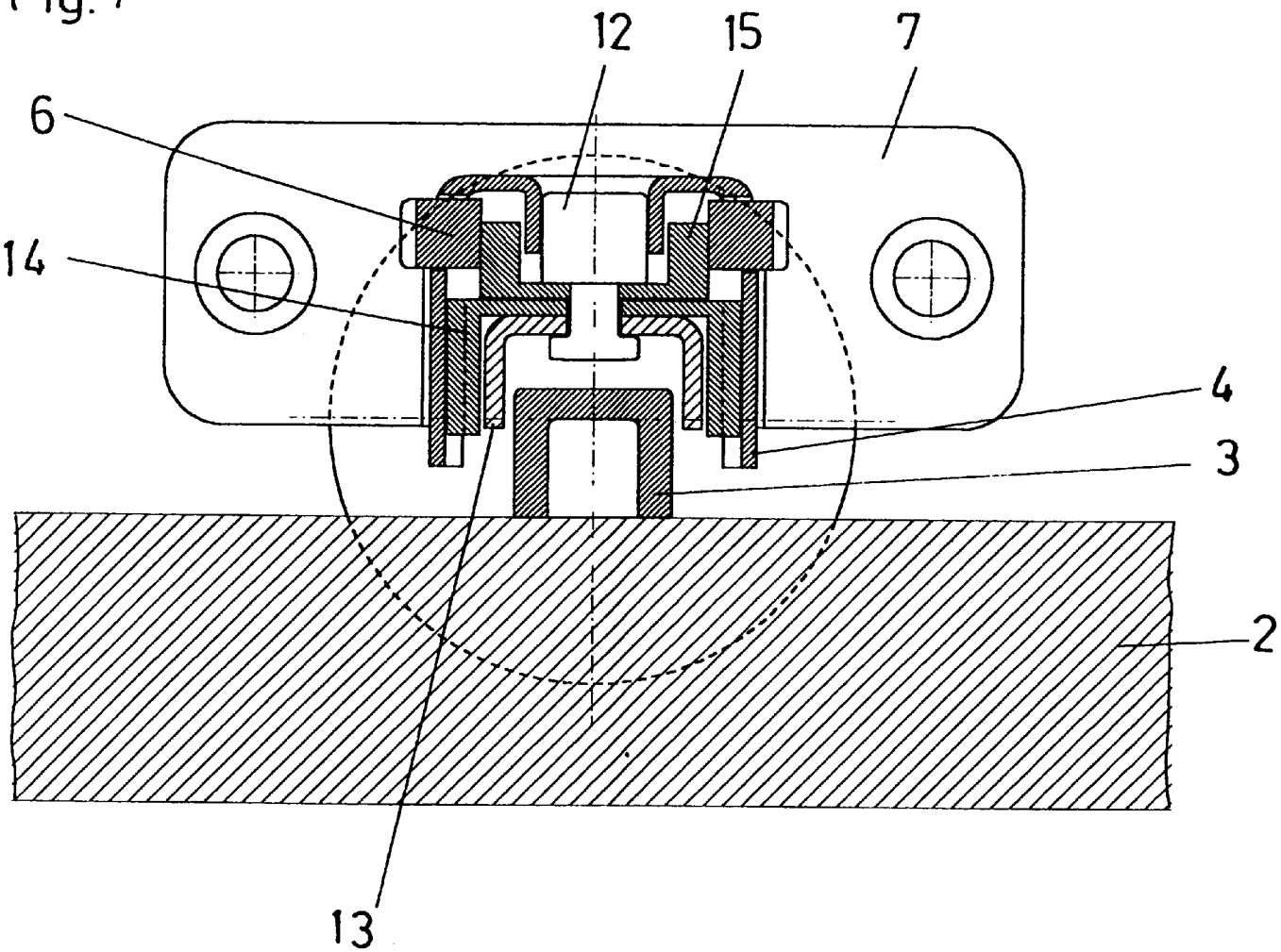
FIG. 7 is a sectional view along line D—D of FIG. 2.
Figure 8:
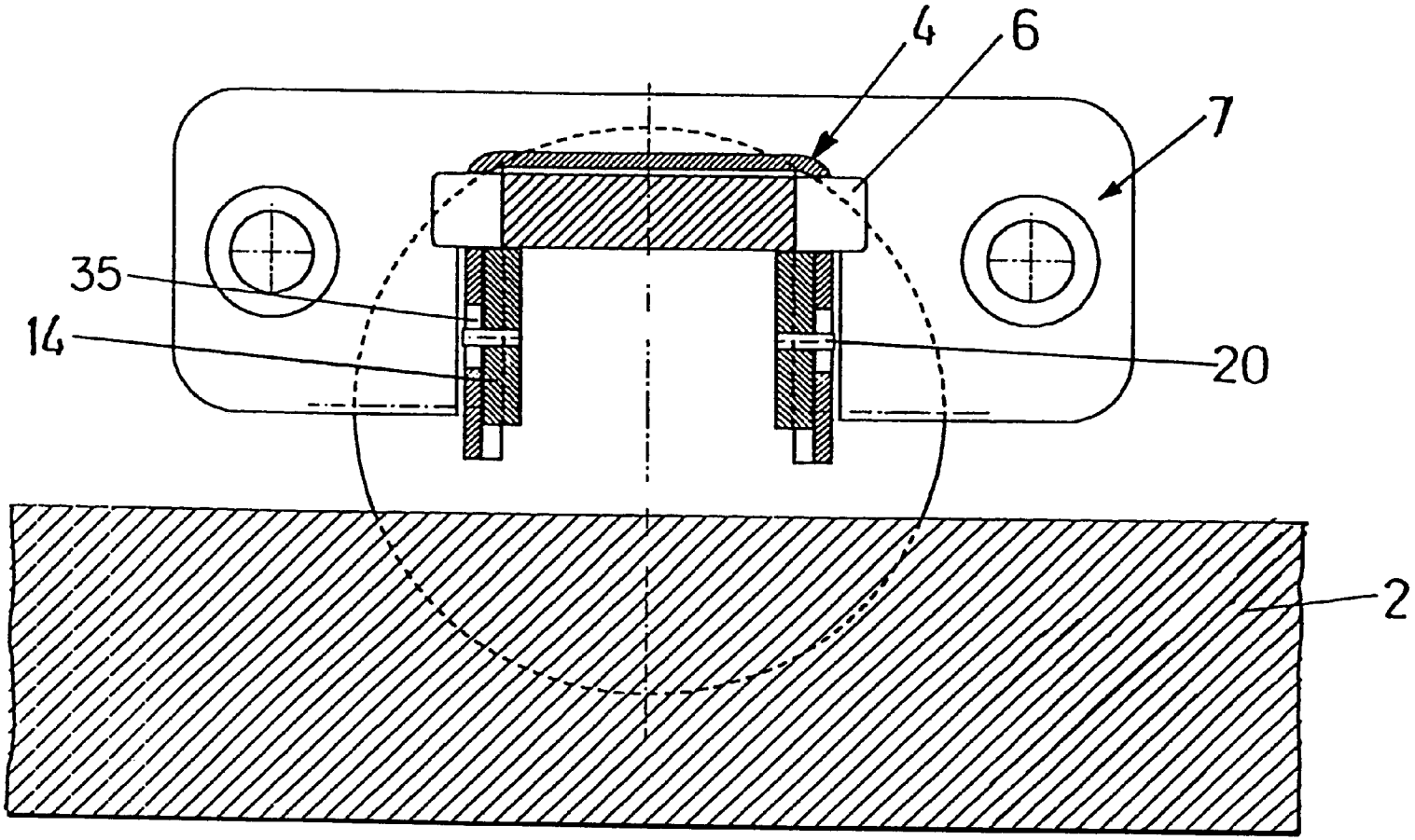
FIG. 8 is a sectional view along line E—E of FIG. 2.

The hinge according to the invention is provided with a hinge arm 4, which is connected to a hinge cup 7 by means of articulated hinge links 17, 18. The hinge cup 7 is inserted into a bore in the door 1.

The base plate 3 is fastened to the furniture side wall 2 by dowels, screws or the like.

The hinge arm 4 is an elongated member with a U-shaped profile. In the embodiment shown two intermediate pieces 13, 14 are held within the U-shaped profile of the hinge arm 4. One of the intermediate pieces 13 is inserted into the other whereby both intermediate pieces 13, 14 also have an elongated form and U-shaped profile.

When the door 1 is mounted, the intermediate pieces 13, 14 are held within the hinge arm 4.

For mounting the door 1 to the furniture side wall 2 the hinge arm 4 is hooked onto the mounting plate 3 by means of axle 11 of the intermediate piece 13. Thereafter, the hinge arm 4 and the intermediate piece 13 are tilted till protrusion 21 of pivot lever 8 snaps into a recess behind nose 22 at the rear end of the mounting plate 3. In this way the intermediate piece 13 together with the intermediate piece 14 and the hinge arm 4 is fastened to the mounting plate 3. A locking pin 10 is provided approximately in the middle of the intermediate piece 13. A locking pin 18 comes to rest in the semicircular notch or recess 23 of the mounting plate 3. In this way the intermediate piece 13 is held on the mounting plate 3 without play.

A disk 19 is mounted on the intermediate piece 14, the disk 19 being provided on its lower side with a groove 24 in the form of a spiral. A peg 16, which is fastened to the intermediate piece 13 protrudes into the groove 24. The peg 16 protrudes through a slot 25 in the intermediate piece 14.

In the embodiment shown, the disk 19 is hexagonal and a wheel 5 with a corresponding opening is fastened to the disk. The wheel 5 is at its outer rim provided with a corrugation or knurling to facilitate turning of the wheel 5. The wheel 5 protrudes through openings 27 in the two lateral webs of the hinge arm 4.

Near its front end the hinge arm 4 is provided with an adjustment screw 12 for a lateral adjustment of the hinge arm 4. The adjustment screw 12 is held in female thread 28 of the hinge arm 4 and is provided with a head 29 which is held behind the two intermediate pieces 13, 14. Shaft 30 of the adjustment screw 12 protrudes through open slots 31, 32 in the intermediate pieces 13, 14.

The shaft 30 of the adjustment screw 12 is fastened to a coupling member 15 in such a way that the adjustment screw 12 is not turnable with respect to the coupling member 15. Like the disk 19, the coupling member 15 is also hexagonal and is inserted in a corresponding opening of a wheel 6. Like the wheel 5, the wheel 6 is at its rim provided with a corrugation or knurling 33 which makes turning of the wheel 6 easier. The wheel 6 protrudes through openings 34 in the hinge arm 4.

By turning the wheel 6, the adjustment screw 12 is turned and the hinge arm 4 is moved either towards the mounting plate 3 or away from the mounting plate 3.

Turning of the wheel 5 results in turning of the disk 19, whereby the intermediate piece 14 is moved with respect to the intermediate piece 13 because of the peg 16, which protrudes into the groove 24 of the disk 19. In this way, the hinge arm 4 is displaced in the direction of the depth of the piece of furniture.

Near the front ends the intermediate pieces 13, 14 are provided with lateral pegs 20, which protrude into slots 35 in the lateral webs of the hinge arm 4. The slots 34 together with the pegs 20 limit the range of possible lateral adjustment of the hinge arm 4.

What is claimed is:

1. A hinge comprising:

a base plate to be secured to a furniture part;

at least one intermediate member connectable to said base plate;

a hinge arm connectable to said at least one intermediate member, said hinge arm having a U-shaped profile including two lateral walls;

a first adjusting device to enable adjustment of said hinge arm relative to said at least one intermediate member in a direction substantially parallel to said base plate;

a second adjusting device to enable adjustment of said hinge arm relative to said at least one intermediate member in directions toward and away from said at least one intermediate member; and each of said first adjusting device and said second adjusting device including a manually operable member mounted within said U-shaped profile of said hinge arm and extending through an opening in at least one said lateral wall thereof.

2. A hinge as claimed in claim 1, wherein said at least one intermediate member includes a first intermediate member connectable to said base plate and a second intermediate member connectable to said first intermediate member and to said hinge arm.

3. A hinge as claimed in claim 2, wherein said manually operable member of said first adjusting device includes a disk mounted on said second intermediate member, said disk having a spiral groove, and said first adjusting device further includes a peg on said first intermediate member and fitting in said groove, whereby turning of said disk causes displacement of said second intermediate member and said hinge arm relative to said first intermediate member in said direction substantially parallel to said base plate.

4. A hinge as claimed in claim 3, wherein each of said first intermediate member and said second intermediate member has a U-shaped profile, one said intermediate member being positioned within the other said intermediate member.

5. A hinge as claimed in claim 4, wherein said first intermediate member is positioned within said second intermediate member.

6. A hinge as claimed in claim 5, wherein each of said first intermediate member and said second intermediate member has an elongated shape.

7. A hinge as claimed in claim 2, wherein each of said first intermediate member and said second intermediate member has a U-shaped profile, one said intermediate member being positioned within the other said intermediate member.

8. A hinge as claimed in claim 7, wherein each of said first intermediate member and said second intermediate member has an elongated shape.

9. A hinge as claimed in claim 2, wherein each of said first intermediate member and said second intermediate member has an elongated shape.

10. A hinge as claimed in claim 1, wherein said manually operable member of said first adjusting device includes a disk having a spiral groove, and said first adjusting device further includes a peg on said at least one intermediate member and fitting in said groove, whereby turning of said disk causes displacement of said hinge arm relative to said at least one intermediate member in said direction substantially parallel to said base plate.

11. A hinge as claimed in claim 1, wherein said manually operable member of said second adjusting device includes a wheel coupled to an adjustment screw threadably engaged with said hinge arm and having a head held in said at least one intermediate member.

12. A hinge as claimed in claim 11, further comprising a coupling member between said adjustment screw and said wheel.

13. A hinge as claimed in claim 1, wherein each said manually operable member comprises a wheel.

14. A hinge as claimed in claim 1, wherein each said manually operable member extends through openings in both of said two lateral walls of said hinge arm.

* * * * *